US012599801B2

(12) United States Patent
Male

(10) Patent No.: US 12,599,801 B2
(45) Date of Patent: Apr. 14, 2026

(54) TRAMPOLINE

(71) Applicant: BOOGIE BOUNCE HOLDINGS LIMITED, Staffordshire (GB)

(72) Inventor: Andrew William Male, Staffordshire (GB)

( * ) Notice: Subject to any disclaimer, the term of this patent is extended or adjusted under 35 U.S.C. 154(b) by 22 days.

(21) Appl. No.: 18/252,960

(22) PCT Filed: Nov. 11, 2021

(86) PCT No.: PCT/GB2021/052920
§ 371 (c)(1),
(2) Date: May 15, 2023

(87) PCT Pub. No.: WO2022/101631
PCT Pub. Date: May 19, 2022

(65) Prior Publication Data

US 2023/0414985 A1 Dec. 28, 2023

(30) Foreign Application Priority Data

| | | |
|---|---|---|
| Nov. 13, 2020 | (GB) | 2017894 |
| Nov. 13, 2020 | (GB) | 2017895 |
| Nov. 13, 2020 | (GB) | 2017896 |
| Nov. 13, 2020 | (GB) | 2017897 |
| Apr. 22, 2021 | (GB) | 2105767 |

(51) Int. Cl.
*A63B 5/11* (2006.01)

(52) U.S. Cl.
CPC ..... *A63B 5/11* (2013.01); *A63B 2210/50* (2013.01)

(58) Field of Classification Search
CPC ..... A63B 5/11; A63B 2210/50; A63B 71/023; A63B 71/0054
See application file for complete search history.

(56) References Cited

U.S. PATENT DOCUMENTS

| | | | | |
|---|---|---|---|---|
| 2,600,572 A * | 6/1952 | Purviance | ..... | A63B 5/11 482/28 |
| 4,598,905 A | 7/1986 | Vrana | | |
| 4,824,100 A * | 4/1989 | Hall | ..... | A63B 5/11 482/28 |

(Continued)

FOREIGN PATENT DOCUMENTS

| | | | | |
|---|---|---|---|---|
| CA | 2314858 A1 * | 2/2001 | ..... | A63B 5/11 |
| CN | 2491059 Y | 5/2002 | | |

(Continued)

OTHER PUBLICATIONS

ISR; European Patent Office; Dec. 4, 2022.

(Continued)

*Primary Examiner* — Andrew M Kobylarz
(74) *Attorney, Agent, or Firm* — Patshegen IP; Moshe Pinchas

(57) ABSTRACT

Disclosed herein is a trampoline (100) comprising a frame and a balance handle. The frame comprises a bracket (114) arranged to receive the balance handle to secure the balance handle to the frame at a first position along the balance handle. The frame further comprises a balance handle engaging member (704) shaped to engage with a correspondingly shaped part of the balance handle to secure the balance handle to the frame at a second position along the balance handle.

15 Claims, 13 Drawing Sheets

(56) References Cited

U.S. PATENT DOCUMENTS

| | | | | |
|---|---|---|---|---|
| 6,129,649 | A | 10/2000 | Yang | |
| 6,939,270 | B2 * | 9/2005 | Wang | A63B 5/11 482/28 |
| 8,047,967 | B1 | 11/2011 | Teng | |
| 2007/0004560 | A1 | 1/2007 | Nelson | |
| 2007/0072738 | A1 * | 3/2007 | Lai | A63B 5/11 482/28 |
| 2008/0090704 | A1 * | 4/2008 | Denis | A63B 5/11 482/28 |
| 2013/0210590 | A1 * | 8/2013 | Publicover | A63B 5/11 482/110 |
| 2014/0287880 | A1 * | 9/2014 | Publicover | F16C 11/04 482/28 |
| 2017/0232288 | A1 * | 8/2017 | Ho | A63B 5/11 482/28 |
| 2017/0239503 | A1 * | 8/2017 | Goldwitz | A63B 5/11 |
| 2017/0239504 | A1 * | 8/2017 | Chen | A63B 71/022 |
| 2020/0023224 | A1 * | 1/2020 | Publicover | A63B 21/02 |
| 2020/0206553 | A1 | 7/2020 | Shen | |
| 2020/0282285 | A1 | 9/2020 | Colling | |

FOREIGN PATENT DOCUMENTS

| | | | | | |
|---|---|---|---|---|---|
| CN | 200998552 | Y | | 4/2007 | |
| CN | 201894795 | U | * | 7/2011 | |
| CN | 205127257 | U | | 4/2016 | |
| CN | 206414665 | U | | 8/2017 | |
| CN | 206444055 | U | * | 8/2017 | |
| CN | 208319783 | U | | 1/2019 | |
| CN | 208641629 | U | * | 3/2019 | |
| CN | 210543064 | U | | 9/2019 | |
| CN | 211383609 | U | | 12/2019 | |
| CN | 110787405 | A | | 2/2020 | |
| CN | 210125125 | U | | 3/2020 | |
| CN | 210447943 | U | * | 5/2020 | A63B 5/11 |
| CN | 2010813678 | U | | 6/2020 | |
| CN | 211132831 | U | | 7/2020 | |
| CN | 211836036 | U | | 11/2020 | |
| CN | 212439836 | U | * | 2/2021 | |
| CN | 113769322 | A | * | 12/2021 | A63B 5/11 |
| CN | 215691316 | U | * | 2/2022 | |
| CN | 114849132 | A | * | 8/2022 | |
| DE | 29904939 | U | | 7/1999 | |
| DE | 20110464 | U1 | * | 9/2001 | A63B 5/11 |
| DE | 202014007636 | U1 | | 10/2014 | |
| EP | 2377581 | A2 | | 11/2011 | |
| EP | 3207960 | A1 | | 8/2017 | |
| GB | 2531166 | A | | 4/2016 | |
| KR | 1020200020165 | A | | 9/2018 | |
| WO | WO-2013075141 | A1 | * | 5/2013 | A63B 5/11 |
| WO | 2018156088 | A1 | | 8/2018 | |

OTHER PUBLICATIONS

GB2017894.3 Search Report; May 6, 2021.
GB2017895.0 Search Report; Mar. 11, 2021.
GB2017896.8 Search Report; Mar. 8, 2021.
GB2017897.6 Search Report; Mar. 12, 2021.
"Replacing V Rings and Springs on Trampoline" Uploaded to Youtube Apr. 11, 2020.
Office Action of GB2017897.6; Intellectual Property Office; Jan. 10, 2025.
Search Report; Aug. 19, 2025.

* cited by examiner

TRAMPOLINE

TECHNICAL FIELD

The present invention relates to trampolines, including foldable trampolines.

BACKGROUND

Home exercise equipment is becoming increasingly popular, particularly when it can be used in conjunction with interactive fitness apps. Trampolines are a well-known type of home exercise equipment. Trampolines are popular because they can provide a high intensity and low impact workout.

Well known trampolines intended for the home exercise market can take up a lot of space within a user's home or garden and can be difficult to set-up and use.

Foldable trampolines provide an alternative to such trampolines. Foldable trampolines have a foldable frame which can be moved between a folded condition for storage and an unfolded condition for use. Foldable trampolines have the advantage that when folded they take up less space so they can be more easily stored within a user's home.

However, many existing foldable trampolines suffer from several disadvantages. For example, it can be difficult, time consuming and potentially dangerous for a user to set up such foldable trampolines (that is, by changing from a condition in which a trampoline can be stored to a condition in which it can be used). Existing foldable trampolines can also be heavy and cumbersome.

Many foldable trampolines include a balance handle that extends above the frame to provide a handle for a user to hold on to when bouncing on the trampoline. Certain arrangements for attaching a balance handle to a trampoline are known. For example, in certain foldable trampolines, a balance handle is attached by engaging with a sleeve welded to one of the trampoline legs. In other foldable trampolines, a balance handle is attached by engaging with a bracket welded to the trampoline frame.

Both of these arrangement for attaching a balance handle to a trampoline suffer from similar disadvantages. Notably, during vigorous use when a user applies large forces to the balance handle while bouncing on the trampoline, the balance handle can become detached from the trampoline.

More particularly, when attached via a sleeve welded to one of the trampoline legs, applying a large force to the balance handle can cause the leg to be bent or in some cases to be entirely torn off the frame. Similarly, when attached via a bracket welded to the frame, applying a large force to the balance handle can cause damage to the bracket or frame, and in some cases, can cause the bracket to be entirely torn off the frame.

Such arrangements for attaching a balance handle to a trampoline can therefore be dangerous to users, particularly if the balance handle fully detaches from the trampoline during vigorous use. Such arrangements can also mean that a user's trampoline can become damaged during normal use. Such damage may be difficult or expensive to repair.

More particularly, during folding and unfolding, existing foldable trampolines tend to require a large force to be applied by a user during the initial part of the folding or unfolding movement to overcome the force applied by the mat and springs to the frame, before tending to snap open or shut during the subsequent part of the folding or unfolding movement.

This "bear trap" like characteristic can be dangerous if a user gets their fingers trapped between the frame when it snaps open or shut. The requirement to apply a large force during the initial part of the folding or unfolding movement can also make such folding trampolines difficult to use, particularly for certain types of users who lack the necessary upper body strength and coordination.

Existing foldable trampolines have ground engaging legs that are attached to the frame in a semi-permanent manner, for example by using one or more hex bolts to secure each leg to the frame. Such legs take up space when the trampoline is stored with the legs still attached or are otherwise cumbersome and slow to remove, requiring a user to use a tool to unfasten one or more bolts connecting each leg to the frame.

Other existing foldable trampolines have ground engaging legs that are attached to the frame via respective short studs provided on the frame. The legs are retained by the frame via respective springs which allow the legs to be folded against the frame when removed from the studs. In such arrangements, it is common for the springs that retain the legs to the frame to break. In some circumstances this can render the foldable trampoline entirely or partially unusable. Attaching the legs in this way also means that undesirable lateral movement of the legs relative to the frame can occur during use.

The trampoline mat is typically attached to the frame by a plurality of resilient connectors such as springs or bungee cords that are spaced apart around the frame.

Existing techniques for securing the resilient connectors to the mat or frame typically rely on permanently attaching the resilient connectors to the mat and/or frame. However, a problem with such attachment techniques is that it can be difficult to disconnect resilient connectors from the trampoline. For example, if a bungee cord is broken and needs to be replaced, if the trampoline needs to be fully disassembled for storage or transportation, or if it is necessary to replace the trampoline mat, it can be difficult or slow for a user to remove the bungee cords.

It is an object of certain embodiments of the invention to obviate or mitigate one or more disadvantages of existing foldable trampolines described above.

SUMMARY OF THE INVENTION

According to a first aspect of the invention there is provided a trampoline comprising a frame and a balance handle. The frame comprises a bracket arranged to receive the balance handle to secure the balance handle to the frame at a first position along the balance handle. The frame further comprises a balance handle engaging member shaped to engage with a correspondingly shaped part of the balance handle to secure the balance handle to the frame at a second position along the balance handle.

Optionally, when received in the bracket and engaged with the balance handle engaging member, a first end of the balance handle is arranged to contact the ground to support the frame.

Optionally, a second end of the balance handle is integral with or connectable to a bar that is positioned for a user to hold on to when bouncing on the trampoline.

Optionally, the balance handle further comprises a leg arranged such that, when the balance handle is received in the bracket and engaged with the balance handle engaging member, the leg contacts the ground to support the frame.

Optionally, the leg is arranged to extend laterally outwardly with respect to the frame.

Optionally, the trampoline further comprises a releasable fastener arranged to releasably secure the balance handle to the balance handle engaging member when the balance handle is engaged with the balance handle engaging member.

Optionally, the releasable fastener is arranged such that the action of engaging the balance handle with the balance handle engaging member causes the releasable fastener to releasably secure the balance handle to the balance handle engaging member.

Optionally, the releasable fastener is a button clip.

Optionally, the button clip is actuatable between a first position in which it can secure the balance handle to the balance handle engaging member and a second position in which it releases the balance handle from the balance handle engaging member, and the button clip is biased towards the first position.

Optionally, the button clip comprises a bent strip of resilient material with a protrusion arranged to releasably engage with an aperture.

Optionally, the balance handle engaging member comprises a tube extending out from the frame.

Optionally, the balance handle comprises a corresponding tube engageable with the tube of the balance handle engaging member.

Optionally, the releasable fastener is located within the tube of the balance handle engaging member or the tube of the balance handle.

Optionally, the leg is connected to the tube of the balance handle.

Optionally, the bracket projects inwardly with respect to the frame.

Optionally, the bracket is arranged such that the portion of the balance handle received by the bracket is received within an outer periphery of the frame. The portion of the balance handle received by the bracket may be received within an inner periphery of the frame, for example, between the frame and a mat attached to the frame.

Optionally, the trampoline further comprises a mat attached to the frame, the mat providing a surface for a user to bounce on.

Optionally, the trampoline is a foldable trampoline.

Advantageously, embodiments of the invention provide a trampoline that has a balance handle that is connected to the trampoline in a stronger and more resilient manner to minimise the risk of the trampoline becoming damaged or the balance handle becoming detached from the trampoline in use. In this way, the balance handle can withstand greater forces applied by a user without such forces causing damage to the trampoline and harm to the user.

The balance handle can also be easily and quickly attached and detached from the trampoline to facilitate convenient storage of the trampoline when it is not in use.

According to a second aspect of the invention there is provided a foldable trampoline comprising a foldable frame, a mat attached to the frame along an attachment axis of the frame, and a hinge about which the frame is foldable. A pivot point of the hinge is positioned on or substantially adjacent to the attachment axis of the frame to thereby minimise a stretching force exerted on the mat during folding of the frame about the hinge.

Optionally, the attachment axis defines a central axis of the frame.

Optionally, the frame comprises at least two elongate frame members.

Optionally, the at least two elongate frame members are connected via the hinge.

Optionally, the hinge comprises a first hinge part connected to or integral with a first of the at least two elongate frame members, and a second hinge part connected to or integral with a second of the at least two elongate frame members.

Optionally, the first hinge part and the second hinge part are connected via one or more pins received within corresponding apertures of the first hinge part and the second hinge part such that the first hinge part and the second hinge part can pivot about the one or more pins.

Optionally, the hinge is a first hinge and the foldable trampoline comprises a further hinge, a pivot point of the further hinge positioned on or substantially adjacent to the attachment axis of the frame.

Optionally, the at least two elongate frame members are connected via the further hinge.

Optionally, the first and further hinges are positioned at substantially opposite sides of the frame.

Optionally, the first hinge part and the second hinge part each comprise a further aperture offset from the aperture about which the first hinge part and the second hinge part can pivot, and positioned such that when the frame is fully unfolded, the further aperture of the first hinge part is aligned with the further aperture of the second hinge part to receive a pin to thereby prevent movement of the hinge.

Optionally, the frame is shaped to substantially surround the mat.

Optionally, the frame is substantially annular.

Optionally, the mat is attached to the frame by one or more resilient connectors.

Optionally, the mat is attached to the frame by a plurality of resilient connectors spaced apart around the frame.

Optionally, the plurality of resilient connectors are bungee cords.

Optionally, the bungee cords loop around the frame.

Optionally, the plurality of resilient connectors are springs.

Optionally, the pivot point of the hinge is positioned such that, in use, the pivot point is above the attachment axis of the frame.

Advantageously, embodiments of the invention provide a foldable trampoline that is easier, quicker and less complicated for a user to set up and use. Additionally, the foldable trampoline requires less force to be applied by a user during the folding or unfolding movement. This means the foldable trampoline can be used by a wider range of people.

Advantageously, embodiments of the invention provide a foldable trampoline that is safer to set up and use. More specifically, the foldable trampoline has a reduced tendency to snap open or shut during the folding/unfolding movement. This reduces the risk of a user's fingers getting trapped between the frame or ground, thereby improving safety.

Advantageously, positioning the pivot point of the hinge above the attachment axis of the frame permits the frame to be folded such that legs or leg engaging members of the frame face outwardly when the trampoline is folded. This means that the spacing of the pivot point from attachment axis can be made smaller than would otherwise be possible if legs or leg engaging members had to be accommodated within the folded trampoline. This can further reduce the force that need be applied by a user when folding/unfolding the trampoline.

According to a third aspect of the invention there is provided a trampoline comprising a frame and a plurality of legs securable to the frame. The frame comprises at least one leg engaging member shaped to engage with a leg of the plurality of legs. The trampoline further comprises a self-actuating releasable fastener arranged to releasably secure the leg to the leg engaging member when the leg is engaged with the leg engaging member.

Optionally, the releasable fastener is arranged such that the action of engaging the leg with the leg engaging member causes the releasable fastener to releasably secure the leg to the leg engaging member.

Optionally, the releasable fastener is a button clip.

Optionally, the button clip is actuatable between a first position in which it can secure the leg to the leg engaging member and a second position in which it releases the leg from the leg engaging member, and the button clip is biased towards the first position.

Optionally, the button clip comprises a bent strip of resilient material with a protrusion arranged to releasably engage with an aperture.

Optionally, the leg engaging member comprises a tube extending out from the frame.

Optionally, the leg comprises a corresponding tube engageable with the tube of the leg engaging member.

Optionally, the releasable fastener is located within the tube of the leg engaging member or the tube of the leg.

Optionally, the leg engaging member is arranged to engage with the leg such that when engaged, the leg is positioned at a predetermined orientation relative to the frame.

Optionally, a ground engaging end of the leg comprises a rubber foot.

Optionally, the frame comprises one or more further leg engaging members shaped to engage with corresponding legs of the plurality of legs.

Optionally, the trampoline further comprises a mat attached to the frame, the mat providing a surface for a user to bounce on.

Optionally, the trampoline is a foldable trampoline.

Advantageously, embodiments of the invention provide a trampoline that is easier, quicker and less complicated for a user to set up and use. More particularly, the legs of the trampoline can be conveniently engageable with the frame via corresponding leg engaging members of the frame and can be releasably attachable to the frame to facilitate easy assembly and disassembly of the trampoline. This means that a user can quickly and easily attach and release legs from the frame as they are setting up the trampoline for use or disassembling the trampoline for storage. When the legs are removed, the trampoline takes up less space, making it easier to store.

According to a fourth aspect of the invention there is provided a trampoline comprising a frame, a mat, a plurality of resilient connectors attaching the mat to the frame, and a plurality of releasable attachment hoops. Each resilient connector is attached to the mat or the frame via a corresponding attachment hoop.

Optionally, the attachment hoop comprises a gate movable between an open position in which a resilient connector can be attached to or detached from the attachment hoop, and a closed position in which a resilient connector can be retained within the attachment hoop.

Optionally, the attachment hoop is biased towards the closed position.

Optionally, the attachment hoop comprises a hook shaped region positioned to engage with an end of the gate when the gate is in the closed position to limit lateral movement of the gate.

Optionally, the attachment hoop is a carabiner.

Optionally, the attachment hoop is substantially triangular in shape.

Optionally, a first end of each resilient connector is connected to the frame.

Optionally, a second end of each resilient connector is connected to the mat via the releasable fastener.

Optionally, the plurality of resilient connectors are bungee cords.

Optionally, the bungee cords loop around the frame.

Optionally, the plurality of resilient connectors are springs.

Optionally, an edge of the mat comprises a plurality of loops each arranged to connect with a corresponding attachment hoop.

Optionally, the trampoline is a foldable trampoline.

Advantageously, embodiments of the invention provide a trampoline where resilient connectors such as bungee cords are securely attached between the mat and the frame so that they are not at risk of becoming detached from the trampoline when it is in use while also facilitating easy and quick removal of resilient connectors by a user, for example, to replace damaged resilient connectors or to fit a replacement mat.

Various further features and aspects of the invention are defined in the claims.

BRIEF DESCRIPTION OF THE DRAWINGS

Embodiments of the present invention will now be described by way of example only with reference to the accompanying drawings where like parts are provided with corresponding reference numerals and in which.

DETAILED DESCRIPTION

Figure 1:
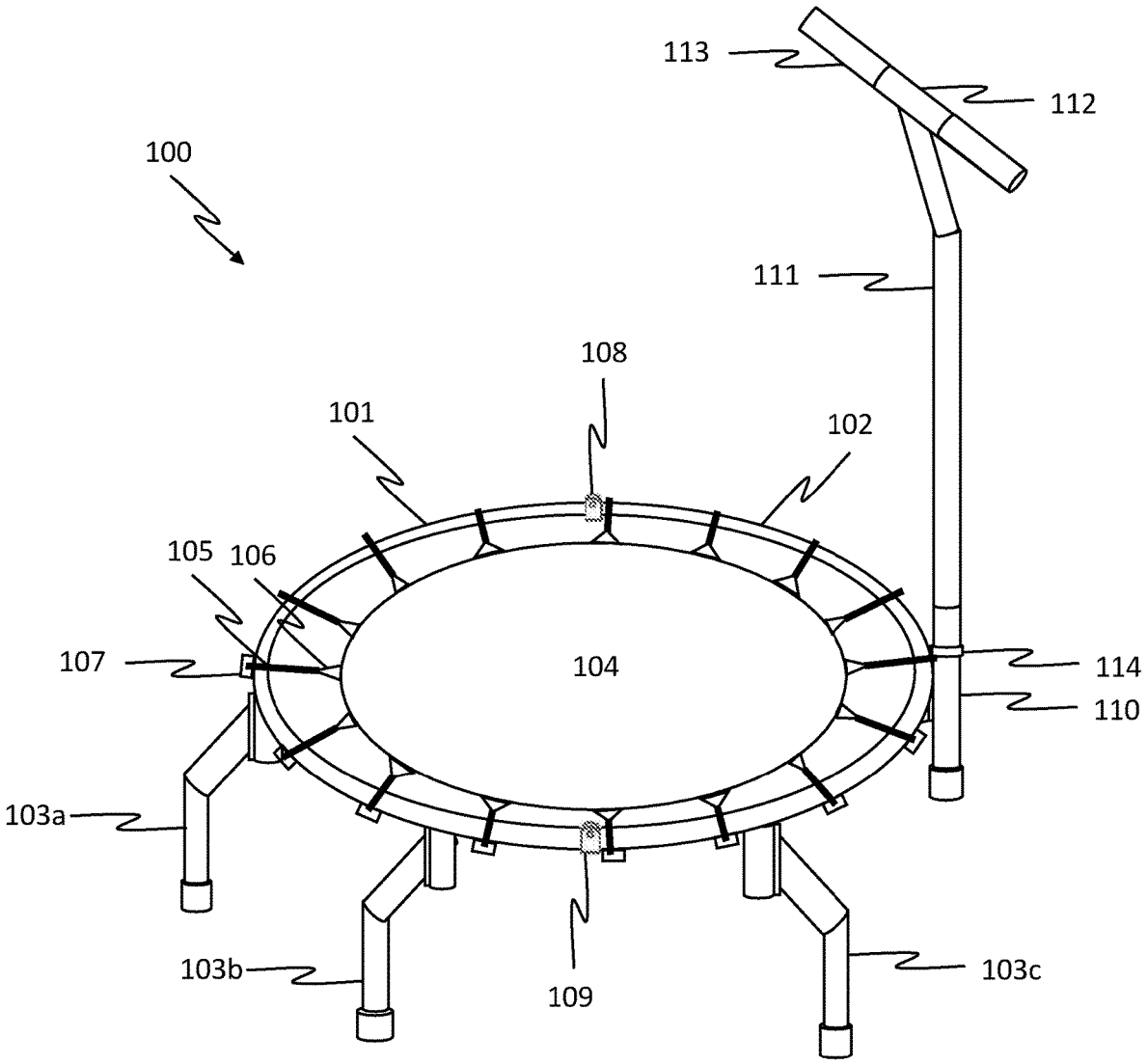
FIG. 1 is a simplified schematic diagram of a foldable trampoline in accordance with embodiments of the invention.

FIG. 1 is a simplified schematic diagram of a foldable trampoline in accordance with embodiments of the invention.

The foldable trampoline 100 includes a frame. The frame includes a first elongate frame member 101 and a second elongate frame member 102. The first elongate frame member 101 and second elongate frame member 102 are substantially curved so that the frame is substantially annular in shape. The first elongate frame member 101 and second elongate frame member 102 can be composed of cylindrical or box section tube bent to form the desired shape.

The foldable trampoline 100 includes a plurality of ground engaging legs secured to and supporting the frame. FIG. 1 shows a first leg 103*a*, a second leg 103*b*, a third leg 103*c* and a leg part 110 of a balance handle providing a fourth leg. The legs can include rubber feet to improve grip with the ground.

The foldable trampoline 100 includes a mat 104. The mat 104 provides a surface for a user to bounce on. The mat 104 is attached to the frame via a plurality of resilient connectors spaced apart around the frame including a first resilient connector 105. The resilient connectors hold the mat 104 taut and provide a rebound force when a user bounces on the mat 104.

In this embodiment, the resilient connectors are bungee cords that loop around the frame and connect to the mat 104 via a plurality of releasable attachment hoops including a first attachment hoop 106. The attachment hoops 106 can be secured to respective loops of material located around the outside edge of the mat 104. A suitable arrangement for attaching the mat 104 to the frame is shown in more detail in FIG. 2.

The bungee cords are held in position relative to the frame via a plurality of respective guides including a first guide 107.

The foldable trampoline 100 includes a first hinge 108. The first hinge 108 connects the first elongate frame member 101 and second elongate frame member 102. The first hinge 108 includes a pivot point about which the frame can be folded. A suitable arrangement for the hinge is shown in more detail in FIGS. 3*a* and 3*b*. The pivot point of the hinge is positioned such that, when the trampoline is placed on a floor for use, the pivot point is above the central axis of the frame. The pivot point is located on the side of the frame opposite the side of the frame from which the ground engaging legs extend.

The foldable trampoline 100 includes a second hinge 109. The second hinge 109 substantially corresponds with the first hinge 108. The second hinge 109 is positioned at the opposite side of the frame to the first hinge 108 so that the frame can be folded in two.

The foldable trampoline 100 includes a balance handle. The balance handle comprises a leg part 110 which is secured to the second elongate frame member 102 and engages with the ground in a manner described in more detail with reference to FIGS. 7*a* and 7*b*.

The balance handle includes an upper part 111 that is connected to or integral with the leg part 110. The upper part 111 includes a region that is angled with respect to the remainder of the handle towards a position of a user during use of the foldable trampoline 100.

The balance handle includes a substantially horizontal handle bar 112 that is connected to or integral with the upper part 111. The handle bar 112 provides a structure for a user to hold on to when bouncing on the mat 104. The handle bar 112 includes neoprene grips covering parts of the handle bar 112 where a user makes contact with the handle bar 112 including first neoprene grip 113.

The foldable trampoline 100 includes a bracket 114 attached to the second elongate frame member 102. The bracket 114 is shaped to receive the leg part 110 of the balance handle to prevent lateral movement of the balance handle when the foldable trampoline 100 is in use. The foldable trampoline 100 also includes a balance handle engaging member. The attachment between the trampoline frame and the balance handle is described in more detail with reference to FIGS. 7*a* and 7*b*.

It will be understood that in other embodiments, the frame can include more than two elongate frame members.

It will be understood that in other embodiments, the foldable trampoline 100 can include more or fewer ground engaging legs.

It will be understood that in other embodiments, other forms of connection between the mat 104 and frame can be provided. For example, the resilient connectors can be springs such as helically coiled springs.

Figure 2:
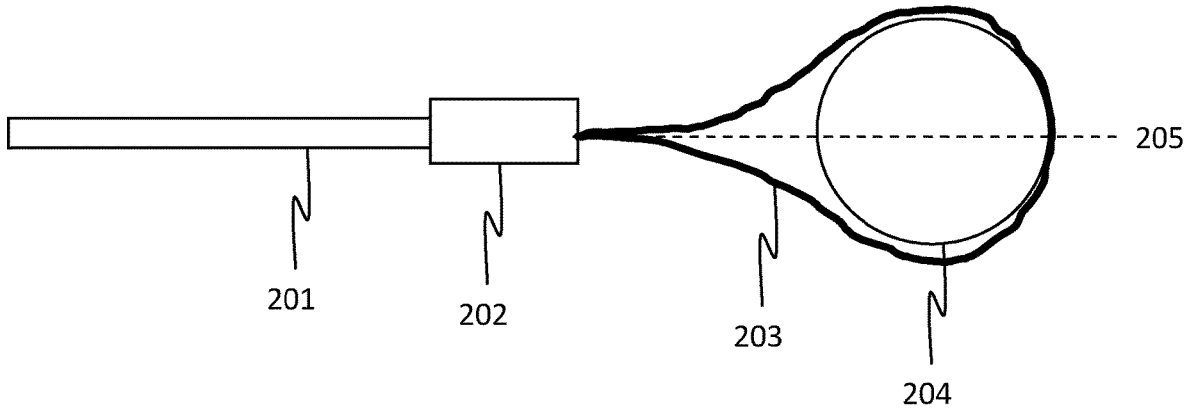
FIG. 2 is a simplified schematic sectional diagram showing a mat attached to a frame of a foldable trampoline in accordance with embodiments of the invention.

FIG. 2 is a simplified schematic sectional diagram showing a mat attached to a frame of a foldable trampoline in accordance with embodiments of the invention.

FIG. 2 shows part of a mat 201, a releasable attachment hoop 202, a resilient connector 203 and a foldable trampoline frame 204 (typically one of the elongate frame members of the frame).

The mat 201 provides a surface for a user to bounce on. The mat 201 is attached to the foldable trampoline frame 204 via a resilient connector 203. The resilient connector 203 is composed of a resilient material such as rubber to provide a rebound force when a user bounces on the mat 201. In this embodiment, the resilient connector 203 is a length of bungee cord. The resilient connector loops around the foldable trampoline frame 204 and connect at a first end to the mat 201 via the attachment hoop 202.

The attachment hoop 202 can be secured to the mat 201 by passing it through a loop of material located on the edge of the mat 201 or by another suitable technique. Suitable arrangements for the attachment hoop 202 are described in more detail herein and in particular with reference to FIG. 8*a*, FIG. 8*b* and FIG. 9.

FIG. 2 also shows the axis 205 along which the mat 201 is attached to the foldable trampoline frame 204, which is referred to herein as the attachment axis of the frame. The attachment axis 205 is the axis along which the mat 201 is attached to the foldable trampoline frame 204. In the embodiment shown in FIG. 2, because the mat 201 is attached to the foldable trampoline frame 204 by the resilient connector 203 looping around the foldable trampoline frame 204, which is circular in cross section, the attachment axis 205 extends through the central axis of the foldable trampoline frame 204.

It will be understood that in other embodiments, other means of attaching the mat to the foldable trampoline frame can be used. For example, rather than looping a bungee cord around the foldable trampoline frame, one end of the resilient connector could be fixed to the attachment hoop and the other end could be fixed to an attachment point on the foldable trampoline frame. In such an embodiment, the attachment axis would extend through the attachment point on the foldable trampoline frame.

Figure 3A:
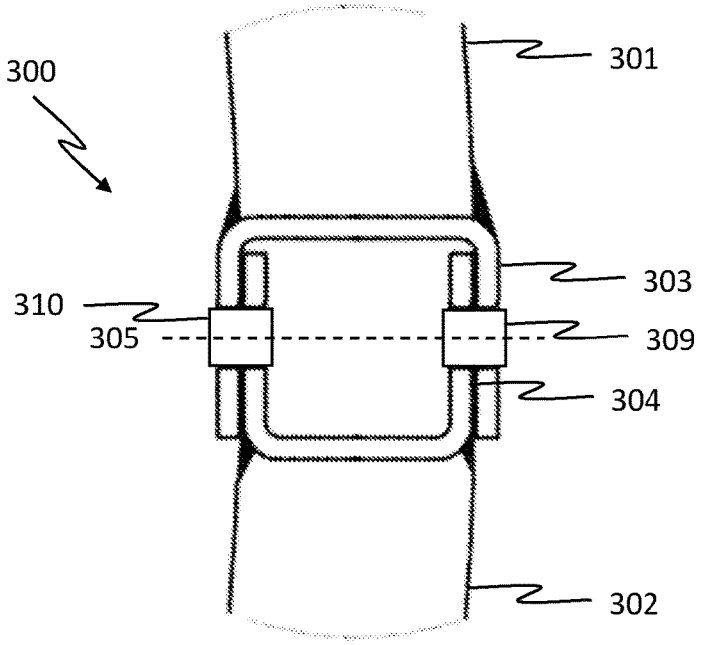
FIG. 3*a* is a simplified schematic diagram showing a plan view of a hinge of a foldable trampoline in accordance with embodiments of the invention.
Figure 3B:
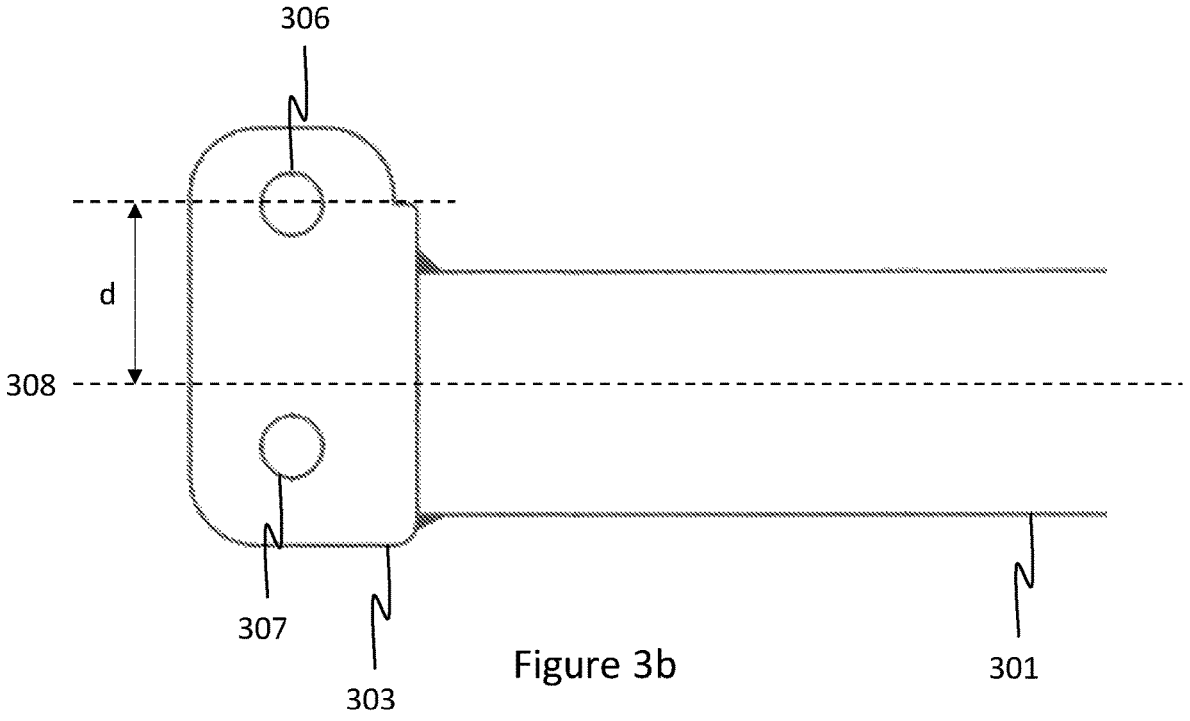
FIG. 3*b* shows a side view of part of the hinge of FIG. 3*a;*

FIG. 3*a* is a simplified schematic diagram showing a plan view of a hinge of a foldable trampoline in accordance with embodiments of the invention. FIG. 3*b* shows a side view of part of the hinge of FIG. 3*a*.

The hinge 300 connects adjacent parts of the frame. In this embodiment, the hinge 300 connects the first elongate frame member 301 and the second elongate frame member 302. The hinge 300 allows the first elongate frame member 301 and second elongate frame member 302 to pivot with respect to each other about a pivot point of the hinge. As described above, typically a foldable trampoline has two corresponding hinges located at opposite sides of the frame to allow the frame to fold in half.

The hinge 300 includes a first hinge part 303 and a second hinge part 304. The first hinge part 303 and second hinge part 304 each include first and second outwardly extending arm portions. The first hinge part 303 and second hinge part 304 are shaped so that the arm portions of the second hinge part 304 can be received within the arm portions of the first hinge part 303.

The arm portions of the first hinge part 303 and the arm portions of the second hinge part 304 include corresponding pivot apertures. The pivot apertures are positioned so that pins 309 310 can be received through the apertures to secure the first hinge part 303 to the second hinge part 304 and allow pivoting of the first hinge part 303 relative to the second hinge part 304 about the pins 309 310. FIG. 3*a* shows an axis 305 through which the pins 309 310 are provided through the pivot apertures of the first hinge part 303 and second hinge part 304.

The first hinge part 303 and second hinge part 304 can be secured to or integral with the frame.

The arm portions of the first hinge part 303 and the arm portions of the second hinge part 304 include corresponding further apertures. The further apertures are offset from the pivot apertures of the hinge and positioned such that they are aligned when the frame is fully unfolded. The further apertures are arranged so that when a pin is received in the further apertures, movement of the hinge about the pivot point is prevented. This can securely fix the frame in an unfolded condition for use.

FIG. 3*b* shows a side view of the first elongate frame member 301 and first hinge part 303. The first hinge part 303 includes a first pivot aperture 306 that extends through the arm portions of the first hinge part 303. As described above, the first pivot aperture 306 is positioned to receive a pin to secure the first hinge part 303 to the second hinge part 304. The pin received within the pivot apertures of the first hinge part 303 and second hinge part 304 provides the pivot point of the hinge. The hinge is arranged to rotate around the pivot point.

FIG. 3*b* also shows the attachment axis 308 of the frame. In this embodiment, a mat is arranged to be attached to the frame by looping bungee cord around the frame and therefore the attachment axis 308 passes through the centre of the elongate frame members that make up the frame.

In the embodiment shown in FIG. 3*b*, the pivot point of the hinge, which passes through the centre of the first pivot aperture 306, is positioned substantially adjacent to the attachment axis 308 of the frame (separated by distance d).

Positioning the pivot point of the hinge on or substantially adjacent to the attachment axis 308 in this way can minimise the force exerted on the mat during folding of the frame about the hinge.

More particularly, it has been determined that the distance between the pivot point of the hinge and the attachment axis of the frame influences the forces associated with folding and unfolding the foldable trampoline. This is because a greater distance between the pivot point of the hinge and the attachment axis of the frame causes a greater amount of stretching of the resilient connectors that secure the mat to the frame during the action of folding and unfolding the trampoline. The resultant force from the resilient connectors acts to resist the action of unfolding the trampoline during the initial part of the unfolding movement. After the initial part, the resultant force from the resilient connectors acts to cause the frame to snap open. This can make it difficult and potentially dangerous for users to fold and unfold such a trampoline.

It has been determined that reducing or entirely eliminating the distance between the pivot point of the hinge and the attachment axis of the frame can minimise the stretching force applied to the mat and thereby make folding and unfolding easier because less force is required to fold and unfold, and safer because the tendency of the frame to snap open or closed is reduced.

The first hinge part 303 includes a further aperture 307. The further aperture 307 is offset from the first pivot aperture 306. The further aperture 307 is arranged to receive a pin when the trampoline is unfolded such that when a pin is received in the further aperture 307, movement of the hinge about the pivot point is prevented.

It will be understood that other suitable hinge arrangements could be used. For example, in other embodiments, each hinge part could include a single arm.

It will be understood that the hinges can be integral with the frame or can be provided as separate components secured to parts of the frame.

It will be understood that in other embodiments, the pivot point of hinge can be provided on the attachment axis of the frame.

Figure 4A:
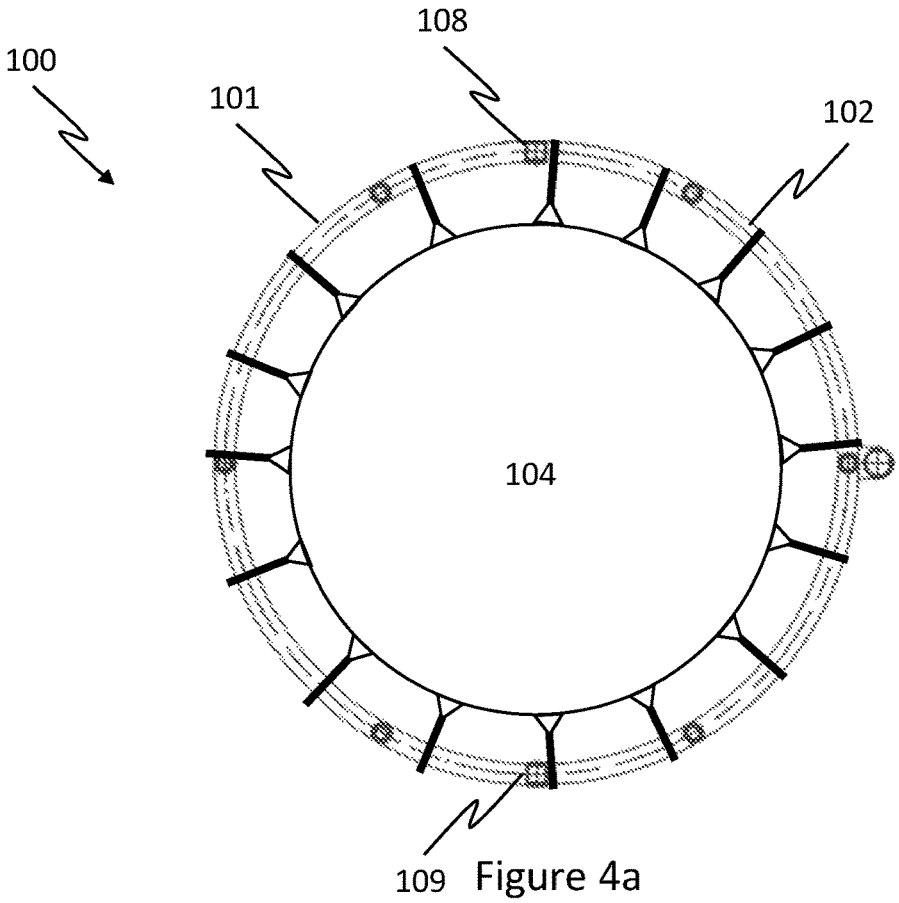
FIG. 4*a* is a simplified schematic diagram showing a top view of the foldable trampoline of FIG. 1 in an unfolded condition in accordance with embodiments of the invention.
Figure 4B:
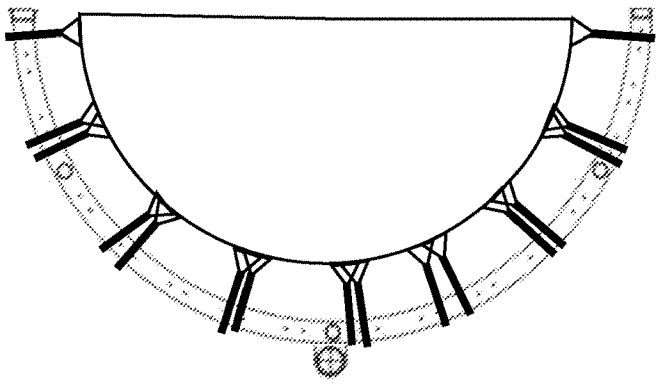
FIG. 4*b* shows the trampoline of FIG. 4*a* in a folded condition.

FIG. 4*a* is a simplified schematic diagram showing a top view of the foldable trampoline of FIG. 1 in an unfolded condition in accordance with embodiments of the invention. FIG. 4*b* shows the trampoline of FIG. 4*a* in a folded condition in accordance with embodiments of the invention. For clarity, some features and reference signs have been omitted from FIGS. 4*a* and 4*b*.

The foldable trampoline 100 is foldable about the first hinge 108 and second hinge 109 between an unfolded condition, which is shown in FIG. 4*a*, and a folded condition, which is shown in FIG. 4*b*. In the unfolded condition, a user can bounce on the mat 104. In the folded condition, the foldable trampoline 100 can be conveniently stored or transported.

To move the foldable trampoline 100 between the unfolded condition and the folded condition, a user applies a force to one side of the frame while the other side of the frame is held. The hinges allow relative movement of the sides of the frame together.

Due to the proximity of the pivot point of the hinges with the axis of the frame along which the mat is attached, the user will experience a small or in some cases substantially no force resisting the folding action in the initial part of the folding motion and a small or in some cases substantially no force urging the foldable trampoline to snap shut during the subsequent part of the folding motion.

Figure 5A:
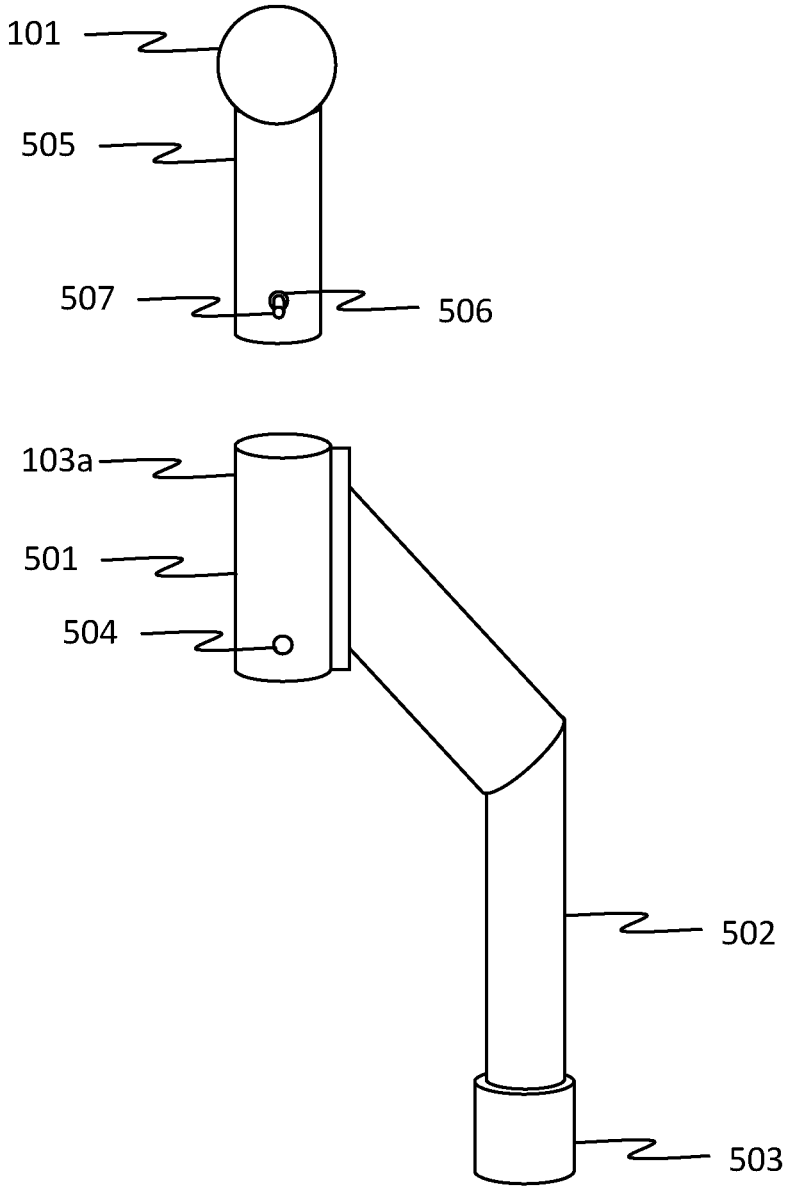
FIG. 5*a* provides a simplified schematic diagram showing one of the legs of the foldable trampoline of FIG. 1 prior to securing with the frame.
Figure 5B:
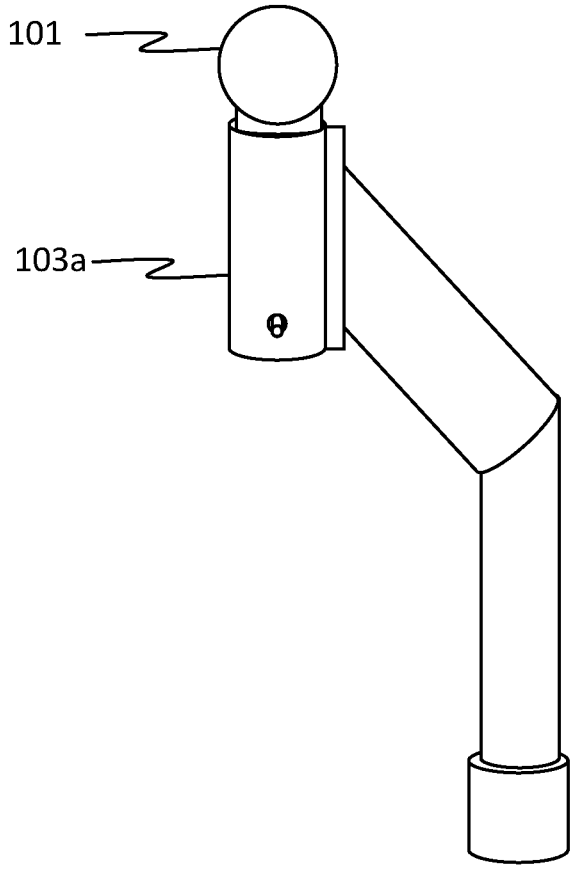
FIG. 5*b* shows the leg of FIG. 5*a* secured with the frame.

FIG. 5*a* provides a simplified schematic diagram showing one of the legs of the foldable trampoline of FIG. 1 prior to securing with the frame and FIG. 5*b* shows the leg secured with the frame. For clarity, some reference signs have been omitted from FIG. 5*b*.

The leg 103*a* includes a tubular upper leg portion 501 connected to a lower leg portion 502. An end of the lower leg portion 502 includes a rubber foot 503 arranged to engage with the ground to improve grip.

The leg 103*a* can be substantially curved along its length. When engaged with the frame at a suitable angle, such a shape of the leg 103*a* means that the ground engaging end of the leg 103*a* extends laterally outwardly from the frame to thereby increase the surface area of contact with the ground and improve the stability of the trampoline.

The tubular upper leg portion 501 includes an aperture 504.

FIG. 5*a* also shows part of the trampoline frame (corresponding to the first elongate frame member 101) in partial cross-section. The first elongate frame member 101 includes a leg engaging member 505 in the form of a tube extending out from the first elongate frame member 101.

The leg engaging member 505 is shaped so that it engages with the tubular upper leg portion 501 of the leg 103*a* when the leg 103*a* is moved towards it.

The leg engaging member 505 includes an aperture 506. The leg engaging member 505 also includes releasable fastener 507. In this embodiment, the releasable fastener 507 is a button clip that is located inside the leg engaging member 505 and which includes a protrusion that extends out of the aperture 506. The releasable fastener 507 is self-actuating in that it is arranged to releasably secure the leg engaging member 505 to the tubular upper leg portion 501 of the first leg 103*a* when the first leg 103*a* is engaged with the leg engaging member 505 by engaging with the aperture 504 of the tubular upper leg portion 501.

Figure 6:
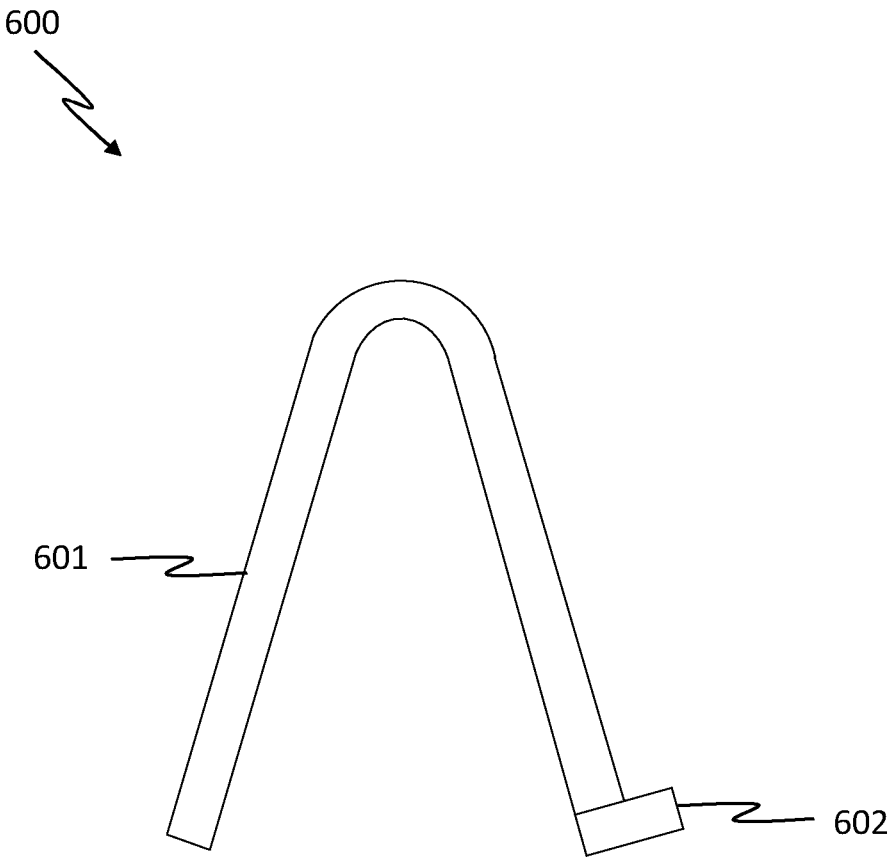
FIG. 6 provides a simplified schematic diagram showing a releasable fastener in the form of a button clip in accordance with embodiments of the invention.

A suitable releasable fastener in the form of a button clip is shown in FIG. 6. The button clip 600 is formed from a bent strip 601 of resilient material such as a suitable metal. The button clip 600 includes a protrusion 602 at or towards an end of the bent strip 601 that is arranged, in a first position which the button clip is biased towards, to extend out from an aperture of the leg engaging member 505 to releasably engage with an aperture 504 of the trampoline leg. The button clip 600 is actuatable into a second position in which it does not extend out from the aperture of the leg engaging member 505 far enough to releasably engage with the aperture 504 of the trampoline leg, thereby releasing the leg.

FIG. 5*b* shows the first leg 103*a* releasably secured with the first elongate frame member 101. To move between the conditions shown in FIG. 5*a* and FIG. 5*b*, the first leg 103*a* is moved towards the leg engaging member 505. The tubular upper leg portion 501 of the first leg 103*a* engages with the leg engaging member 505 and slides up the leg engaging member 505 until it reaches a fixing position.

When it reaches the fixing position, the releasable fastener 507 protrusion aligns with the aperture 504 of the tubular upper leg portion 501 and thereby extends out from the aperture 504 to engage with the tubular upper leg portion 501. This releasably secures the first leg 103*a* to the first elongate frame member 101. In this way, the releasable fastener 507 is self-actuating in that the action of engaging the first leg 103*a* with the leg engaging member 505 causes the releasable fastener 507 to releasably secure the first leg 103*a* to the first elongate frame member 101. This arrangement is shown in FIG. 5*b*.

Any further legs of the trampoline are then attached in the same way until all of the legs are attached and the trampoline is ready for use.

The first leg 103*a* can be released from attachment with the first elongate frame member 101 by pressing the releasable fastener 507 inwardly (i.e. toward the centre of the leg engaging member 505) so that the releasable fastener 507 is moved into a second position where it no longer engages with the aperture 504 of the tubular upper leg portion 501, and simultaneously moving the first leg 103*a* away from the leg engaging member 505.

Any further legs of the trampoline can be removed in the same way until all of the legs are removed and the trampoline is ready for storage.

It will be understood that other suitable releasable fasteners could be provided. It will be understood that in other embodiments with suitable modification, the releasable fastener could be provided in the leg rather than in the leg engaging member 505.

Figure 7A:
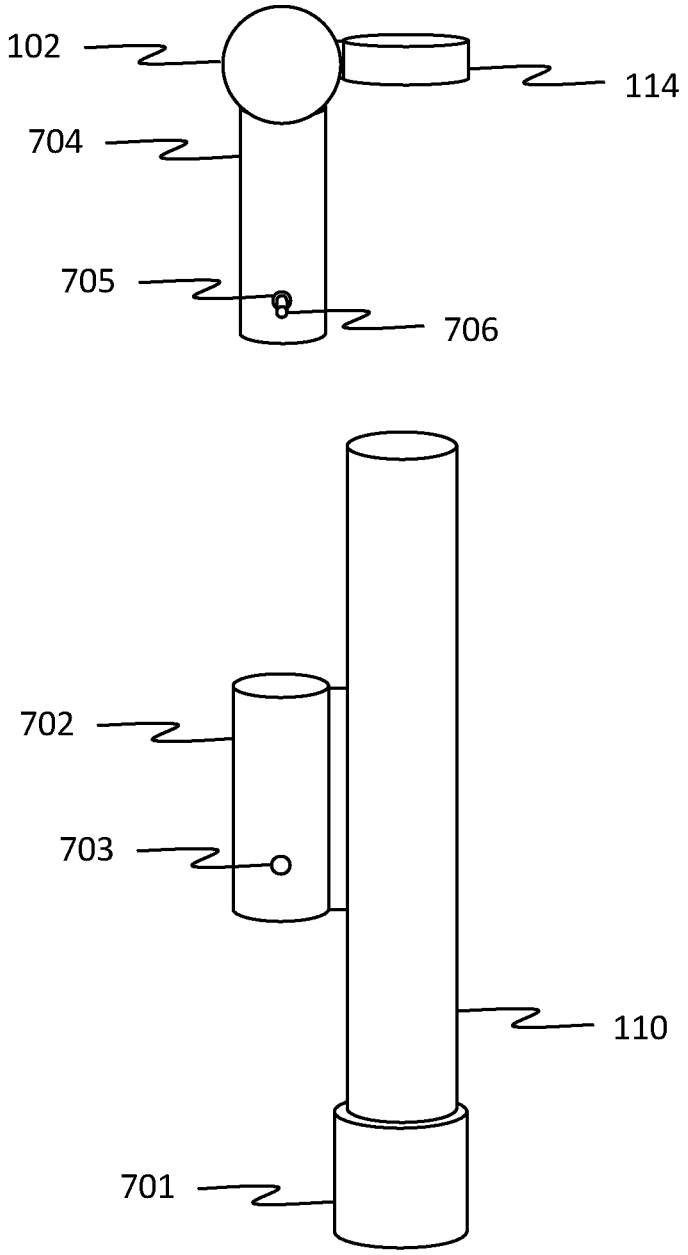
FIG. 7*a* provides a simplified schematic diagram showing the balance handle of the foldable trampoline of FIG. 1 prior to securing with the frame in accordance with embodiments of the invention.
Figure 7B:
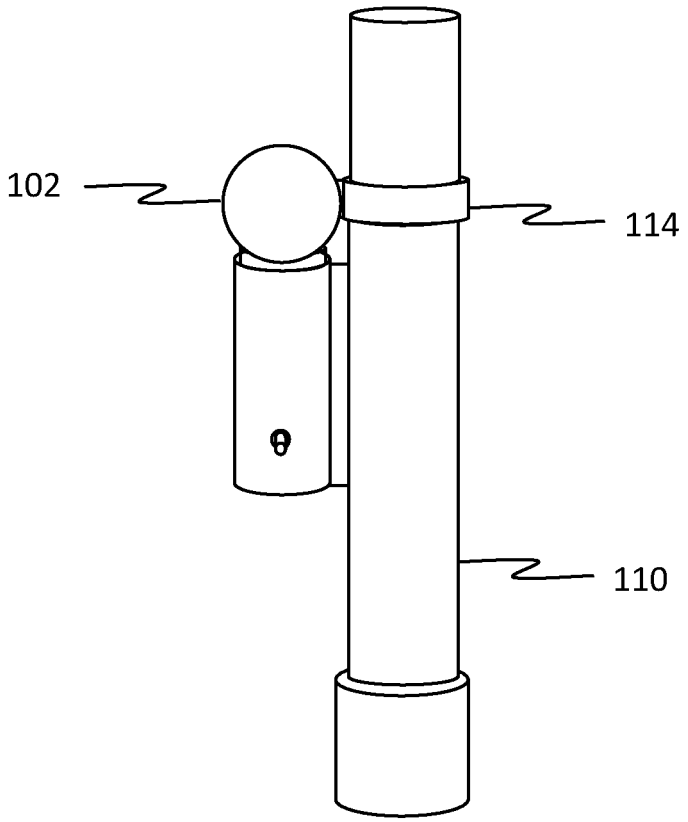
FIG. 7*b* shows the balance handle of FIG. 7*a* secured with the frame.

FIG. 7*a* provides a simplified schematic diagram showing the balance handle of the foldable trampoline of FIG. 1 prior to securing with the frame and FIG. 7*b* shows the balance handle secured with the frame. For clarity, some reference signs have been omitted from FIG. 7*b*.

The balance handle includes a leg part 110. The leg part 110 includes a rubber foot 701 at an end of the leg part 110 that is arranged to contact the ground in use.

The leg part 110 includes a body with a tubular section 702 attached along part of its length. The tubular section 702 includes an aperture 703. An end of the body can be integral with or connectable to (by a suitable connector) a further part of the balance bar that a user holds on to when bouncing on the trampoline.

FIG. 7*a* also shows part of the trampoline frame (corresponding to the second elongate frame member 102) in partial cross-section. The second elongate frame member 102 includes a balance handle engaging member 704 in the form of a tube extending out from the second elongate frame member 102.

The balance handle engaging member 704 is shaped so that it engages with the tubular section 702 of the leg part 110 of the balance handle when the leg part 110 is moved towards it.

The balance handle engaging member 704 includes an aperture 705. The balance handle engaging member 704 also includes a releasable fastener 706. In this embodiment, the releasable fastener 507 is a button clip that is located inside the balance handle engaging member 704 and which includes a protrusion that extends out of the aperture 705. The releasable fastener 706 is self-actuating in that it is arranged to releasably secure the balance handle engaging member 704 to the tubular section 702 of the leg part 110 when the tubular section 702 is engaged with the balance handle engaging member 704 by engaging with the aperture 703 of the tubular section 702.

A suitable releasable fastener in the form of a button clip is shown in FIG. 6. The button clip is typically biased towards a first position in which it extends out from the aperture 705 to secure the tubular section 702 to the balance handle engaging member 704 and is actuatable to a second position in which it does not extend out from the aperture 705 enough to secure the tubular section 702 to the balance handle engaging member 704, thereby releasing the tubular section.

The second elongate frame member 102 also includes a bracket 114. The bracket 114 is an annular bracket that is fixed to or integral with the second elongate frame member 102 and that is arranged to receive the body of the leg part 110 of the balance handle. When received in the bracket 114, the bracket 114 prevents substantial lateral movement of the balance handle.

The trampoline is arranged so that the balance handle can be simultaneously secured to the trampoline frame by the bracket 114 and the balance handle engaging member 704. This can improve the strength and resilience of the connection between the balance handle and the trampoline by securing the balance handle at two spaced apart positions along the balance handle. Additionally, when secured in this way, an end of the balance handle can make contact with the ground to support the frame.

FIG. 7*b* shows the leg part 110 of the balance handle releasably secured with the second elongate frame member 102. To move between the conditions shown in FIG. 7*a* and FIG. 7*b*, the leg part 110 is moved towards the balance handle engaging member 704. The tubular section 702 engages with the balance handle engaging member 704 and slides up the balance handle engaging member 704 until it reaches a fixing position.

When it reaches the fixing position, the releasable fastener 706 protrusion aligns with the aperture 703 of the tubular section 702 and thereby extends out from the aperture 703 to engage with the tubular section 702. This releasably secures the leg part 110 to the balance handle engaging member 704. In this way, the releasable fastener 706 is self-actuating in that the action of engaging the leg part 110 with the balance handle engaging member 704 causes the releasable fastener 706 to releasably secure the tubular section 702 to the second elongate frame member 102. This arrangement is shown in FIG. 7*b*.

As mentioned above, in this configuration, the balance handle is secured to the frame in two spaced apart positions (by the bracket and the balance handle engaging member). This can improve the strength of the connection between the balance handle and the frame so that the trampoline is less liable to become damaged when large forces are applied to the balance handle by a user during use of the trampoline.

When an end of the balance handle is arranged to engage with the ground, the balance handle can also act as a further leg of the trampoline. This can further improve the stability of the balance handle.

The leg part 110 can be released from attachment with the balance handle engaging member 704 by pressing the releasable fastener 706 inwardly (i.e. toward the centre of the balance handle engaging member 704) so that the releasable fastener 706 no longer engages with the aperture 703 of the tubular section 702, and simultaneously moving the leg part 110 away from the balance handle engaging member 704.

It will be understood that other suitable releasable fasteners could be provided. It will be understood that in other embodiments with suitable modification, the releasable fastener could be provided in the leg part 110 rather than in the balance handle engaging member 704.

Figure 8A:
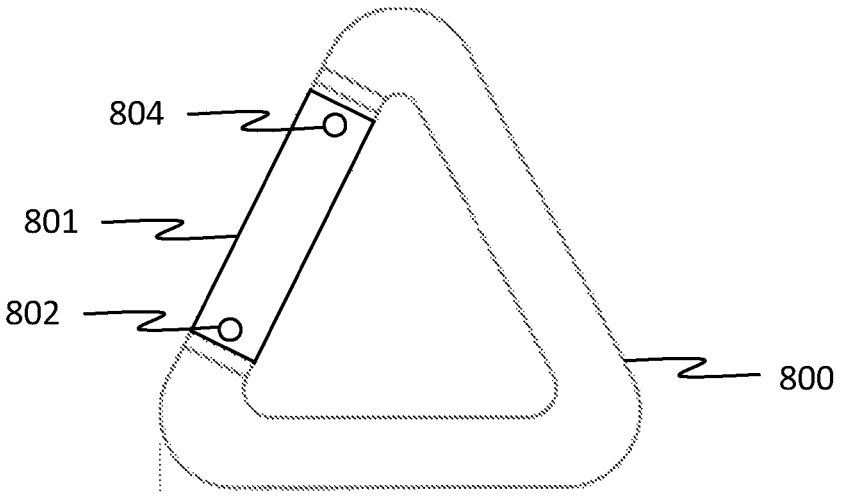
FIG. 8*a* provides a simplified schematic diagram showing a releasable attachment hoop in a closed position in accordance with embodiments of the invention.
Figure 8B:
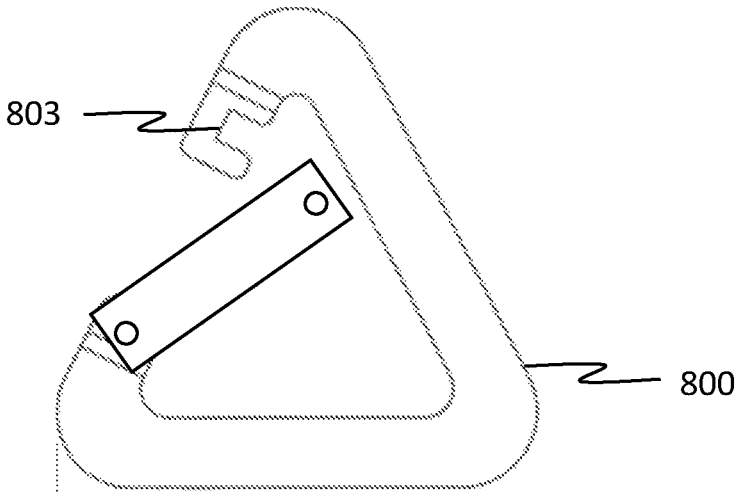
FIG. 8*b* shows the attachment hoop of FIG. 8*a* in an open position.

FIG. 8*a* provides a diagram of a releasable attachment hoop in a closed position in accordance with embodiments of the invention. FIG. 8*b* shows the attachment hoop of FIG. 8*a* in an open position.

The attachment hoop 800 is a carabiner that has three sides to form a substantially triangular shape.

The attachment hoop 800 comprises a gate 801 that extends along one side. The gate 801 is movable between an open position, which is shown in FIG. 8*b*, in which a resilient connector can be attached to or detached from the attachment hoop 800, and a closed position, which is shown in FIG. 8*a*, in which a resilient connector can be retained within the attachment hoop 800. In the closed position, the attachment hoop 800 forms a continuous inner surface which prevents a resilient connector from being removed.

The gate 801 is arranged to pivot about a pivot point provided by a pin 802 that extends through the gate 801 and attachment hoop 800 body. The attachment hoop 800 typically includes a suitable spring mechanism to bias the gate 801 towards the closed position.

The attachment hoop 800 also includes a hook shaped region 803 that is positioned to engage with a further pin 804 that is provided at the movable end of the gate 801.

When the gate 801 is in the closed position (as shown in FIG. 8*a*), the further pin 804 is engaged with the hook shaped region 803 such that at least lateral movement of the gate 801 relative to the remainder of the attachment hoop 800 is limited. This can improve the strength of the attachment hoop 800 by making it more resistant to undesired opening of the gate 801 when the attachment hoop 800 is subject to large forces in use.

The attachment hoop 800 is arranged so that in use the movable end of the gate 801 is positioned at or close to the end of the attachment hoop 800 that a resilient connector engages with. This can further improve the ease with which a resilient connector can be secured to the attachment hoop 800 by reducing the distance the resilient connector needs to stretch by to secure it within the attachment hoop 800.

Figure 9:
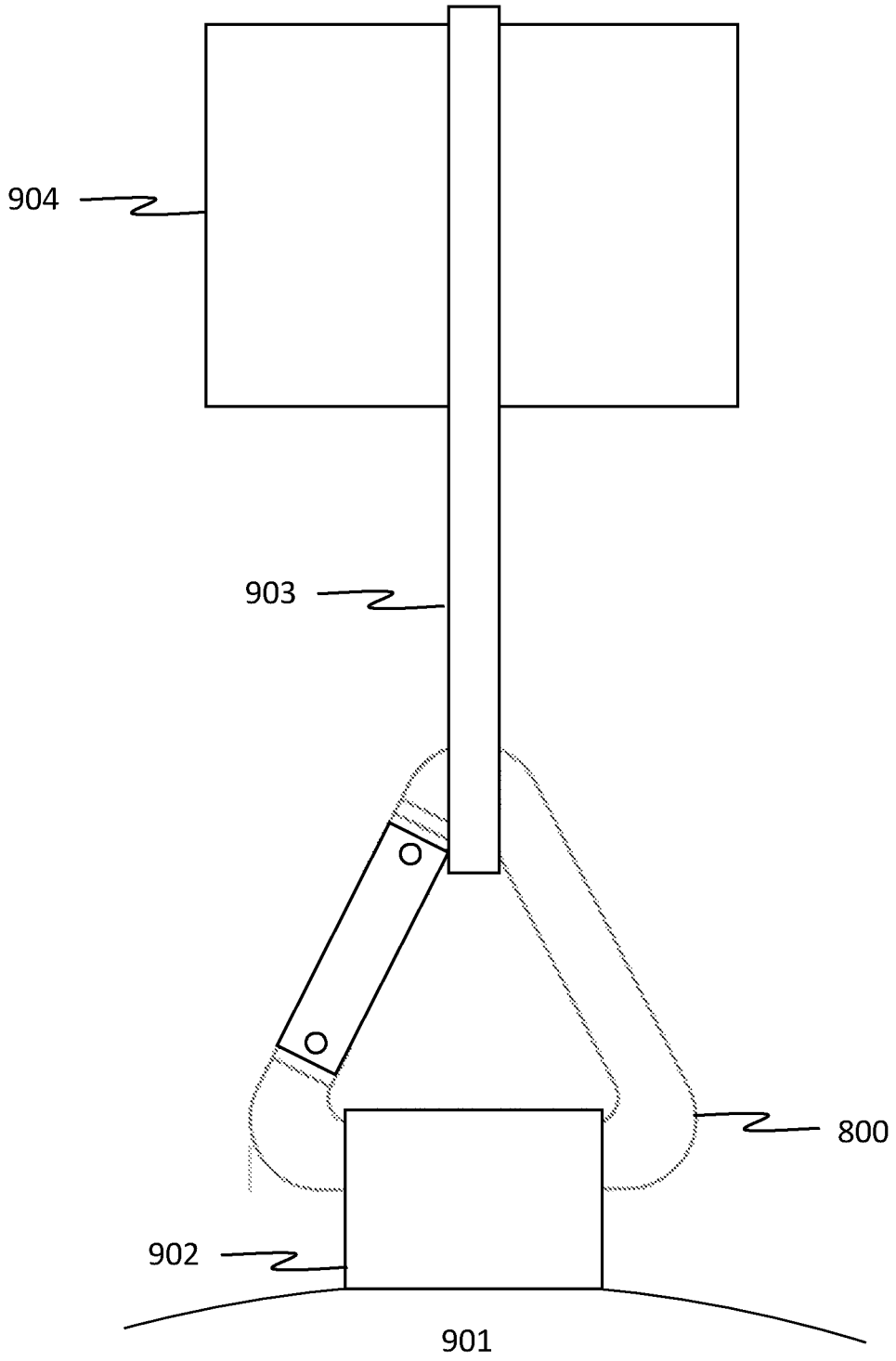
FIG. 9 provides a simplified schematic diagram of the attachment hoop of FIGS. 8*a* and 8*b* in use securing a resilient connector to a mat of a trampoline in accordance with embodiments of the invention.

FIG. 9 provides a simplified schematic diagram of the attachment hoop of FIGS. 8*a* and 8*b* in use securing a resilient connector to a mat of a trampoline in accordance with embodiments of the invention. It will be understood that a trampoline would typically be provided with a plurality of such arrangements spaced apart around the outer edge of the mat.

FIG. 9 shows part of a trampoline mat 901. The trampoline mat 901 includes a loop 902 of material. The loop 902 is arranged to allow the attachment hoop 800 to be passed through it when the gate of the attachment hoop 800 is open to attach the attachment hoop 800 to the trampoline mat 901.

A resilient connector, which in this embodiment is a length of bungee cord 903, is attached to the attachment hoop 800 at a first end.

The bungee cord 903 is looped around the trampoline frame 904 such that it is attached to the trampoline frame 904 at a second end.

As described, the attachment hoop 800 provides a strong and reliable way of attaching the trampoline mat 901 and bungee cord 903 that allows a bungee cord 903 to be quickly and easily removed if necessary by moving the gate of the attachment hoop 800 between the closed and open position.

Such an arrangement can be particularly useful to quickly and easily replace broken bungee cords.

Figure 10:
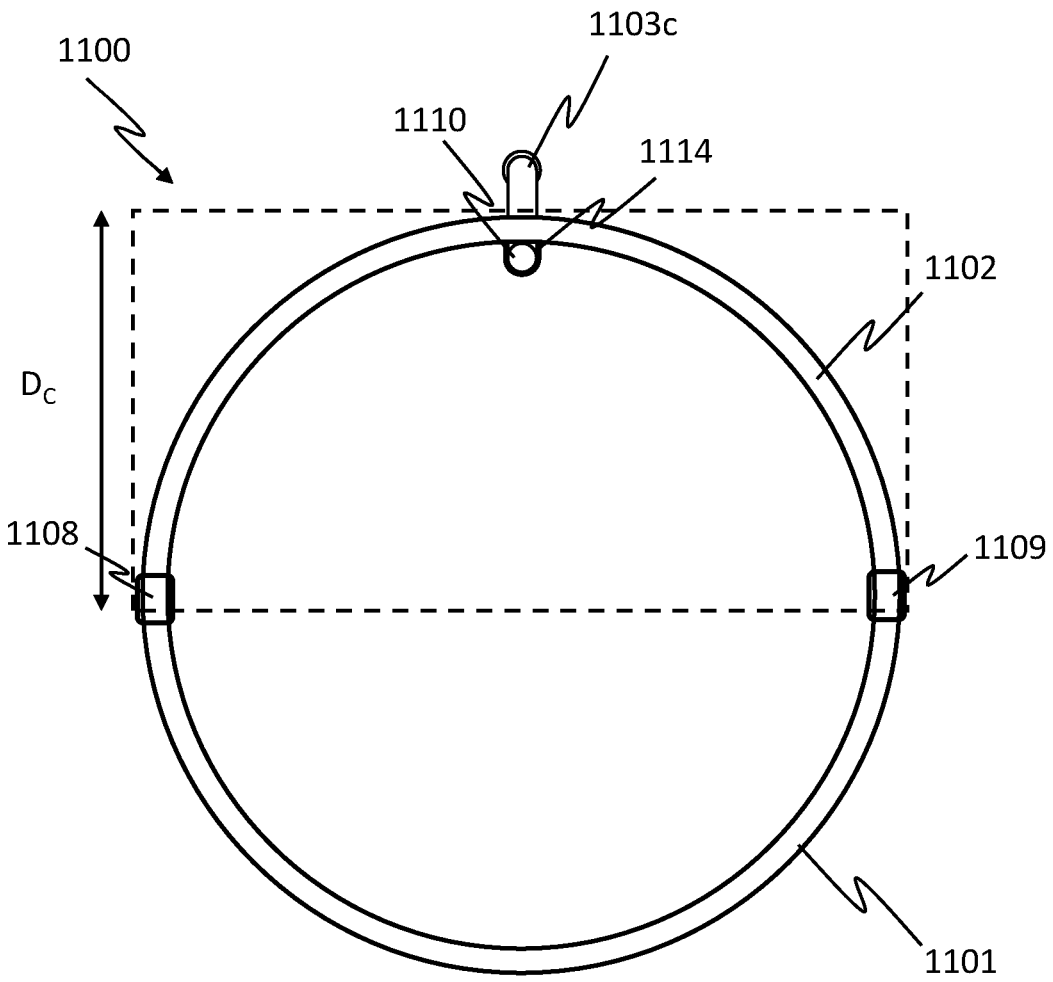
FIG. 10 is a simplified schematic diagram of selected components of a foldable trampoline in accordance with embodiments of the invention.

FIG. 10 is a simplified schematic diagram of a foldable trampoline 1100.

The foldable trampoline 1100 is based on the trampoline shown in FIG. 1 and so only selected components will be described to highlight the differences.

The foldable trampoline 1100 includes a frame which includes a first elongate frame member 1101 and a second elongate frame member 1102. The first elongate frame member 1101 and a second elongate frame member 1102 are connected by first and second hinges 1108, 1109 in the same manner as the embodiment shown in FIG. 1.

Figure 11:
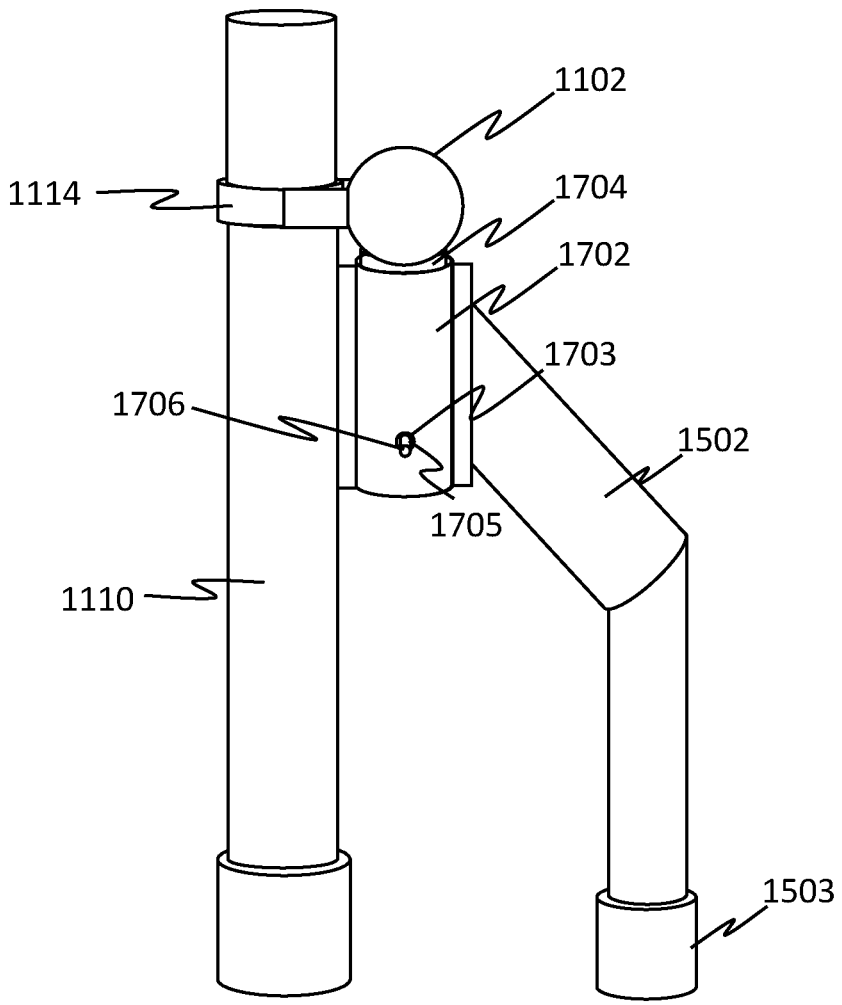
FIG. 11 shows a portion of the foldable trampoline of FIG. 10.

FIG. 11 shows part of the foldable trampoline 1100. The foldable trampoline 1100 includes a balance handle engaging member 1704 and a bracket 1114 attached to the second elongate frame member 1102. The balance handle engaging member 1704 is in accordance with the balance handle engaging member of the embodiment shown in FIGS. 1 and 7*a*. The bracket 1114 projects inwardly from the second elongate frame member 1102, as shown in FIG. 10, and is shaped to receive a leg part 1110 of a balance handle such that the leg part 1110 is received within an outer periphery of the frame, and particularly between the frame and a mat when attached to the frame. The outer periphery of the frame may be defined as the outer periphery of the frame in a plane which the frame extends when in use. In the embodiments described, said plane is parallel and may be substantially coplanar with the plane in which the mat of the trampoline extends when attached to the frame.

The bracket 1114 is arranged to prevent lateral movement of the balance handle when the balance handle is secured to the second elongate frame member 1102 and the foldable trampoline 1100 is in use. The balance handle engaging member 1704 includes an aperture 1705. The balance handle engaging member 1704 also includes a releasable fastener 1706. The releasable fastener 1706 is in accordance with the releasable fastener of the embodiment shown in FIG. 7*a*.

The balance handle is in accordance with the balance handle of the embodiment shown in FIG. 1 and so has a leg part 1110 which includes a body with a tubular section 1702 attached along part of its length. The tubular section 1702 includes an aperture 1703. An end of the body of the leg part 1110 can be integral with or connectable to (by a suitable connector) a further part of the balance bar that a user holds on to when bouncing on the trampoline.

In addition, the balance handle includes a leg portion 1502 which is in accordance with the lower leg portion of the embodiment shown in FIG. 5*a*. The leg portion 1502 includes a rubber foot 1503 arranged to engage with the ground to improve grip. The leg portion 1502 is secured to the tubular section 1702 and arranged to extend laterally outwardly and downwardly from the frame to make contact with the ground when in use. The leg portion 1502 therefore improves stability of the trampoline by making contact with the ground laterally outwardly of the frame in the vicinity of the balance handle.

Arranging the bracket 1114 so that it projects inwardly from the frame means that the bracket is located within the space defined by the frame. The unassembled trampoline can therefore be packaged within a container, such as a box, that has an inner dimension $D_c$ that corresponds to half of the outer diameter of the frame (i.e. the width of the trampoline when folded) rather than having an inner dimension that corresponds to the outer diameter of the frame and a protruding bracket. The impact of the space saving is considerable, and means that significantly more packaged trampolines can be transported in a shipping container or lorry, for example, which can reduce transportation costs. Stability of the trampoline during use, however, is not compromised, and can in fact be improved since the leg portion 1502 secured to the tubular section 1702 makes contact with the ground laterally outwardly of the frame.

Furthermore, the arrangement of the bracket 1114 such that it projects inwardly of the frame is such that any force exerted by a user on the balance handle in a forward direction during use (i.e. in the direction in which a user faces), urges the bracket 1114 against the frame rather than away from the frame (as is the case with the embodiment shown in FIG. 1), and so the connection between the bracket 1114 and the frame is less likely fail, thereby improving the overall robustness of the trampoline arrangement.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features. The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

It will be appreciated that various embodiments of the present disclosure have been described herein for purposes of illustration, and that various modifications may be made without departing from the scope of the present disclosure. Accordingly, the various embodiments disclosed herein are not intended to be limiting, with the true scope being indicated by the following claims.

The invention claimed is:

1. A foldable trampoline comprising:

a foldable frame having legs or leg engaging members;

a mat attached to the frame along an attachment axis of the frame; and a hinge about which the frame is foldable, wherein a pivot point of the hinge is positioned such that, in use, the pivot point is above the attachment axis of the frame thereby permitting the frame to be folded such that the legs or the leg engaging members of the frame face outwardly when the trampoline is folded;

wherein the frame includes at least two elongate frame members connected via the hinge;

wherein the hinge includes a first hinge part connected to or integral with a first elongate frame member of the at least two elongate frame members, and a second hinge part connected to or integral with a second elongate frame member of the at least two elongate frame members; and wherein the first hinge part and the second hinge part each comprise a further aperture offset from a first aperture about which the first hinge part and the second hinge part can pivot, and positioned such that when the frame is fully unfolded, the further aperture of the first hinge part is aligned with the further aperture of the second hinge part to receive a pin to thereby prevent movement of the hinge.

2. The foldable trampoline according to claim 1, wherein the mat is attached to the frame by one or more resilient connectors.

3. The foldable trampoline according to claim 2, wherein the one or more resilient connectors includes a plurality of resilient connectors spaced apart around the frame.

4. The foldable trampoline according to claim 3, wherein the plurality of resilient connectors are bungee cords.

5. The foldable trampoline according to claim 4, wherein the bungee cords loop around the frame.

6. The foldable trampoline according to claim 3, wherein the plurality of resilient connectors are springs.

7. The foldable trampoline according to claim 1, wherein the first hinge part and the second hinge part are connected via one or more pins received within the first aperture of the first hinge part and the second hinge part such that the first hinge part and the second hinge part can pivot about the one or more pins.

8. The foldable trampoline according to claim 7, wherein the at least two elongate frame members are connected via a further hinge.

9. The foldable trampoline according to claim 8, wherein the first hinge and further hinge are positioned at substantially opposite sides of the frame.

10. The foldable trampoline according to claim 1, wherein the frame is shaped to substantially surround the mat.

11. The foldable trampoline according to claim 10, wherein the frame is substantially annular.

12. The foldable trampoline according to claim 1, wherein the pivot point of the hinge is positioned substantially adjacent the attachment axis of the frame to thereby minimize a stretching force exerted on the mat during folding of the frame about the hinge.

13. The foldable trampoline according to claim 1, wherein the attachment axis defines a central axis of the frame.

14. The foldable trampoline according to claim 1, wherein the hinge is a first hinge and the foldable trampoline comprises a further hinge, a pivot point of the further hinge positioned on or substantially adjacent to the attachment axis of the frame.

15. The foldable trampoline according to claim 1, wherein the trampoline comprises a balance handle.

* * * * *